United States Patent [19]

Perevodchikov et al.

[11] 4,059,784

[45] Nov. 22, 1977

[54] ELECTRON-BEAM CONVERTER

[76] Inventors: Vladimir Innokentievich Perevodchikov, ulitsa Krzhizhavovskogo, 4, korpus 2, kv. 32; Valentina Nikolaevna Shapenko, ulitsa Verkhne-Pervomaiskaya, 63, korpus 2, kv. 60; Zarem Sergeevich Chernov, prospekt Garibaldi, 19, kor. 2, kv. 66; Nina Sergeevna Bunina, ulitsa Polyarnaya, 13, kor. 1, kv. 87, all of, Moscow, U.S.S.R.

[21] Appl. No.: 695,980

[22] Filed: June 14, 1976

[51] Int. Cl.[2] ..... H01J 21/14; H01J 21/26

[52] U.S. Cl. ..... 315/349; 313/294; 313/299; 313/303; 315/268; 315/339; 328/254

[58] Field of Search ..... 315/268-270, 315/339, 341, 349, 350; 313/294, 299, 302, 303, 308; 328/252, 254

[56] References Cited

U.S. PATENT DOCUMENTS

| | | | |
|---|---|---|---|
| 2,225,325 | 12/1940 | VanOverbeek | 313/294 X |
| 2,512,858 | 6/1950 | Hegbar | 313/299 X |
| 2,727,177 | 12/1955 | Dailey et al. | 313/299 X |
| 2,769,109 | 10/1956 | Gerard et al. | 313/299 X |
| 3,334,257 | 8/1967 | Doolittle et al. | 313/308 |
| 3,562,576 | 2/1971 | Rusterholz | 313/299 |

FOREIGN PATENT DOCUMENTS

| | | | |
|---|---|---|---|
| 952,893 | 11/1949 | France | 313/299 |

*Primary Examiner*—Eugene R. LaRoche
*Attorney, Agent, or Firm*—Lackenbach, Lilling & Siegel

[57] ABSTRACT

The electron-beam converter comprises at least one of each of the following components: a cathode, an anode and, accelerating and control electrodes. The anode has a surface orthogonal with respect to a diverging electron flow and is arranged with respect to the cathode so that the angle between normals to the surfaces of these electrodes is greater than zero but less than 180°. The accelerating electrode is disposed in the opening of this angle. The control electrodes are arranged near the cathode on either side of the electron flow. A cathode-adjacent focusing electrode is arranged behind the control electrode which is on the cathode side opposite to the accelerating electrode, and an anode-adjacent focusing electrode is inserted between the anode and accelerating electrode. All of said electrodes make up an electron-optical system shaping the electron flow into a beam so as to prevent electrons from impinging upon the accelerating electrode. The potentials across the electrodes are distributed so that there is applied to the accelerating electrode a potential which is positive with respect to the cathode and which has a magnitude sufficient for taking off the required amount of current. The anode potential is positive with respect to the cathode potential but is substantially lower than the accelerating electrode potential. There are applied to the cathode and anode-adjacent focusing electrodes potentials close or equal to the cathode or anode potentials, respectively. The control electrode potentials are equal to the cathode potential during the positive half-cycle, and are negative with respect to the cathode during the negative half-cycle.

9 Claims, 9 Drawing Figures

ELECTRON-BEAM CONVERTER

The present invention relates to high-vacuum converting devices, and more particularly to an electron-beam converter intended for use at high-power substations of d-c transmission lines or as a controlled switch in high-power switching, protecting and inverter circuits.

Known in the art is an electron-beam converter comprising a cathode, an anode, and accelerating and control electrodes. The control electrodes are arranged near the cathode on either side of an electron flow with a cathode-adjacent focusing electrode being arranged behind the control electrode on the cathode side opposite to the accelerating electrode, while an anode-adjacent focusing electrode is inserted between the anode and accelerating electrode; all said electrodes make up an electron-optical system shaping the electron flow into a beam so as to prevent electrons from impinging upon the accelerating electrode. The potentials across the electrodes are distributed so that there is applied to the accelerating electrode a potential which is positive with respect to the cathode and which has a magnitude sufficient for taking off the required amount of current, the anode potential is positive with respect to the cathode but much lower than the accelerating electrode potential, applied to the cathode- and anode-adjacent electrodes are potentials close or equal to the cathode or anode potentials, respectively, and the control electrode potentials are equal to the cathode potential during the positive half-cycle, and are negative with respect to the cathode during the negative half-cycle.

To minimize the number of reflected electrons, the anode is made as a hollow member with holes through which electrons are let therein. As a result, the converter is rendered more powerful as well as sharply increased in size.

Therefore, the principal object of the present invention is to improve said prior art electron-beam converter.

One of the objects of the invention is to provide as small an electron-beam converter as possible, which is still capable of switching heavy currents.

Another object of the invention is to suppress secondary electron emission from the anode as well as to enhance the efficiency of the converter. cathode-adjacent Still another object of the invention is to render the converter capable of switching heavier currents without an increase in its size and complication of its structure.

Yet another object of the invention is to minimize thermal load on the anode.

These and other objects are achieved in that in the proposed electron-beam converter the electron beam is, according to the invention, a curvilinear flow of electrons, broadening as it approaches the anode, for which purpose the angle between normals to the cathode and anode surfaces is greater than zero but less than 180°, the anode having a surface orthoganal relative to the electron flow incident thereupon, and the distance between the accelerating electrode and anode being substantially greater than that between the cathode and the accelerating electrode.

The electron beam thus formed permits reduction of the size of the converter without affecting its ability to switch heavy currents.

It is advisable to provide a grid in direct proximity to the anode, having a potential equal to or lower than the anode potential, but higher than the cathode potential.

This ensures suppression of the secondary electron emission from the anode and a substantially higher efficiency of the converter.

It is also advisable that all said electrodes are made elongate to form a curvilinear ribbon electron beam.

To minimize the thermal load on the anode, the proposed electron-beam converter should preferably have two anodes, two accelerating and two control electrodes.

The cathode, anode, accelerating and control electrodes should advisably be made annular and be arranged concentrically with respect to the axis of symmetry coinciding with the cathode axis. This permits heavier currents to be switched without increasing the size of the converter.

The converter may alternatively have two cathodes, two anodes, and accelerating and control electrodes, all being made annular in shape and being arranged concentrically with respect to the axis of symmetry which coincides with the axis of the cathodes, as a result of which the electron flow is emitted in opposite directions, the accelerating and control electrodes being common for both cathodes. Such an arrangement is structurally simpler and permits heavier currents to be switched.

In an embodiment with a cathode, two anodes, two accelerating and two control electrodes, the cathode should preferably be made cylindrical in shape, while the accelerating and control electrodes should be made in the form of rings having their axis of symmetry coinciding with that of the cathode and being arranged symmetrically to the cathode on either side thereof. This permits heavier currents to be switched and the efficiency of the converter to be substantially enhanced.

The proposed converter may have a plurality of electron-optical systems arranged on a common axis, each including a cylindrical cathode, two annular anodes, two accelerating and two control electrodes. Such an arrangement enables substantially heavier currents to be switched.

The invention will be better understood from the following detailed description with reference to preferred embodiments thereof, taken in conjunction with the accompanying drawings, wherein.

Figure 1:
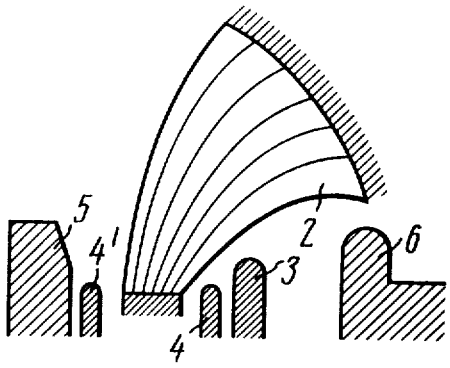
FIG. 1 shows schematically the proposed converter.

In the electron-beam converters described below, use is made of an electron-optical system with centrifugal-electrostatic formation of an electron flow. In such a system, electrons follow curvilinear paths. As it moves along curvilinear paths, an electron is acted upon by a normal component of the electric intensity, a space charge and the centrifugal force. The action of space charge forces in combination with high-intensity external fields and the centrifugal force transverse to the electron path results in an additional rigidity of the electron beam since variations in the space charge level in the beam practically do not affect the beam trajectory. The presence of high-intensity electrostatic fields transverse to the electron paths provides for removal of positive ions from the electron flow, which is especially important in modes of operation preceding the start of oscillations in the case of a sharp deceleration of the electron beam.

Obviously, the additional rigidity of the electron beam and removal of ions from the electron flow are determined by the curvilinearity of the paths.

Thus, the more curvilinear the beam, the more effective the system.

In the proposed electron-optical system, the anode is shaped so that its surface is orthogonal with respect to the electron flow incident thereupon. This results in a minimum electron speed difference, and, as a consequence, a sufficiently low anode potential can be obtained, i.e. the electron flow can be sharply decelerated.

The possibility of forming a divergent electron flow in the electron-optical system rules out formation of a virtual cathode in the vicinity of the anode.

Evidently, if the accelerating electrode is arranged so that the distance between said electrode and the anode is substantially greater than that between the cathoe and accelerating electrode, it becomes possible to reduce the accelerating electrode potential required for taking off a predetermined amount of current for a given value of the voltage being switched. As a result, the efficiency of the converter is improved.

The proposed electron-optical system makes it possible to use elongate electrodes thereby enablng heavier currents to be switched.

The totality of the above-mentioned advantages can be realized while solving the expanding curvilinear electron flow problem.

Referring now to the drawings, the electron-beam converter comprises a cathode 1 (FIG. 1), an anode 2, an accelerating electrode 3 and elongate control electrodes 4 and 4'. The anode 2 has a surface orthogonal with respect to the cathode 1 so that the angle between normals to the surfaces of these electrodes is greater than zero but less than 180°. The accelerating electrode 3 is disposed in the opening of this angle, and the distance between the accelerating electrode 3 and anode 2 is substantially greater than that between the cathode 1 and accelerating electrode 3. The control electrodes 4 and 4' are arranged near the cathode 1 on either side of an electron flow. Arranged behind the control electrode 4', on the side of the cathode 1 opposite to the accelerating electrode 3, is a cathode-adjacent focusing electrode 5, while inserted between the anode 2 and accelerating electrode 3 is an anode-adjacent electrode 6. All of said electrodes make up an electron-optical system with centrifugal-electrostatic formation of an electron flow in the form of a curvilinear beam broadening towards the anode.

The potentials across the electrodes are distributed so that there is applied to the accelerating electrode 3 a potential positive with respect to the cathode 1, the magnitude of said potential being sufficient for taking off the required amount of current, and the potential across the anode 2 is positive with respect to the cathode 1 but much lower than that across the accelerating electrode 3. Applied to the cathoe-adjacent focusing electrode 5 is a potential close or equal to the cathode potential, while the control electrodes 4 and 4' have a potential equal to the cathode potential during the positive halfcycle, and a potential negative with respect to the cathoe 1 during the negative half-cycle.

Figure 2:
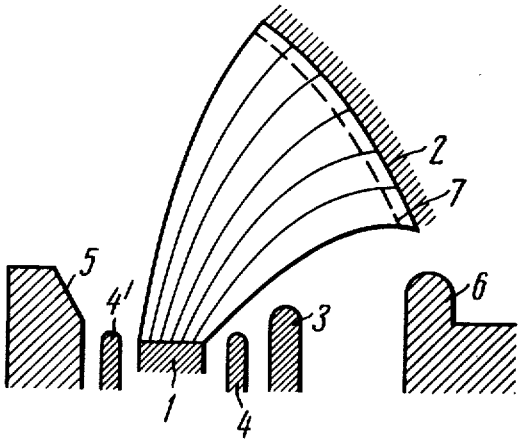
FIG. 2 shows an embodiment of the proposed converter with a grid being provided in proximity to the anode.

The electron-beam converter shown in FIG. 2 also comprises a cathode 1, an anode 2, an accelerating electrode 3 and control electrodes 4, and 4', all of these electrodes being made elongate. The anode 2 has a surface orthoganal with respect to the diverging electron flow and is so arranged relative to the cathode 1 that the angle between normals to the surfaces of these electrodes is greater than zero but less than 180°, the accelerating electrode 3 being disposed in the opening of this angle.

Arranged adjacent to the cathode 1 on either side thereof are the control electrodes 4 and 4'. For the electron beam to be focused, two focusing electrodes are provided: a cathode-adjacent focusing electrode 5 arranged near the control electrode 4' on the side opposite to the accelerating electrode 3, and an anode-adjacent focusing electrode 6 arranged between the accelerating electrode 3 and anode 2. As distinct from the embodiment of FIG. 1, the one under consideration has a grid 7 provided in proximity to the anode 2. By applying to the grid 7 a potential lower than that across the anode 2 but higher than the cathode potential it is possible to create a minimum potential area near the anode 2, which enables retention of the secondary electrons knocked out of the anode 2 by the electron flow incident thereupon. Suppressing the secondary electrons minimizes losses at the electrodes and enhances the efficiency of the converter.

Figure 3:
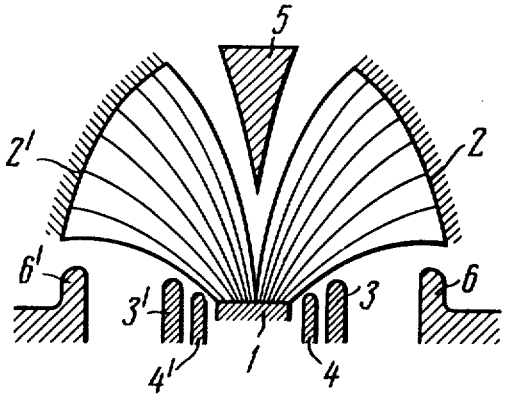
FIG. 3 shows an embodiment of the proposed converter, in which the electron flow is split into two.

The electron-beam converter of FIG. 3 comprises a cathode 1, two anodes 2 and 2', two accelerating electrodes 3 and 3' and two control electrodes 4 and 4', all of there electrodes being made elongate. Both anodes 2 and 2' have surfaces orthogonal with respect to the divergent electron flow and are so arranged relative to the cathode 1 on either side thereof that the angle between normals to the surfaces of the cathode and each anode is greater than zero but less than 180°. The accelerating electrodes 3 and 3'are disposed in the openings of these angles, and the distances between the accelerating electrodes 3, 3' and anodes 2, 2' are substantially greater than those between the cathode 1 and accelerating electrodes 3, 3'. The control electrodes 4 and 4' are arranged between the cathode 1 and each accelerating electrode 3, 3' with anode-adjacent focusing electrodes 6 and 6' being arranged between the acclerating electrodes 3, 3' and the anodes 2, 2'. Arranged above the emitting surface of the cathode 1, symmetrically with the common axis of the converter and between the anodes 2, 2', is a cathode-adjacent focusing electrode 5.

Such an arrangement permits the thermal loads on the anodes to be minimized due to the larger surface of the latter, thereby minimizing total losses in the converter and enhancing its efficiency.

Figure 4:
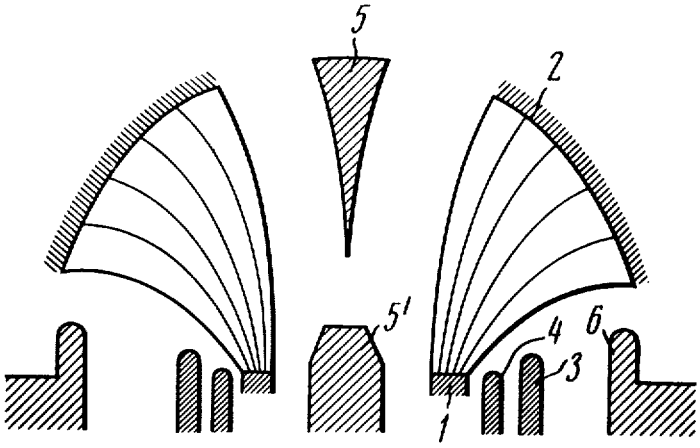
FIG. 4 shows an embodiment of the proposed converter, in which the cathode is made annular.

The electron-beam converter illustrated in FIG. 4 comprises a cathode 1, an anode 2, an accelerating electrode 3 and a control electrode 4, all of these electrodes being made annular and being arranged concentrically with respect to the axis of symmetry of the converter, coinciding with that of the cathode 1. The latter is made as a ring with a flat emitting surface, while the anode 2 has a surface orthogonal relative to the divergent electron beam and is arranged with respect to the cathoe 1 so that the angle between normals to these surfaces is greater than zero but less than 180°. The annular acclerating electrode 3 is disposed in the opening of this angle. The distance between the accelerating electrode 3 and anode 2 is substantially greater than that between the cathode 1 and accelerating electrode 3.

The annular control electrode 4 is disposed between the outer edge of the cathode 1 and the accelerating electrode 3. The following focusing electrodes are provided to focus the electron flow: two cathode-adjacent electrodes 5, 5' and an anode-adjacent electrode 6. The electrode 5 is conical in shape and arranged in the center of the anode 2, while the electrode 5' has a cylindrical shape with a beveled edge and is arranged in the center of the cathode 1. Such an arrangement allows heavier currents to be switched owing to the expanded cathode surface.

Figure 5:
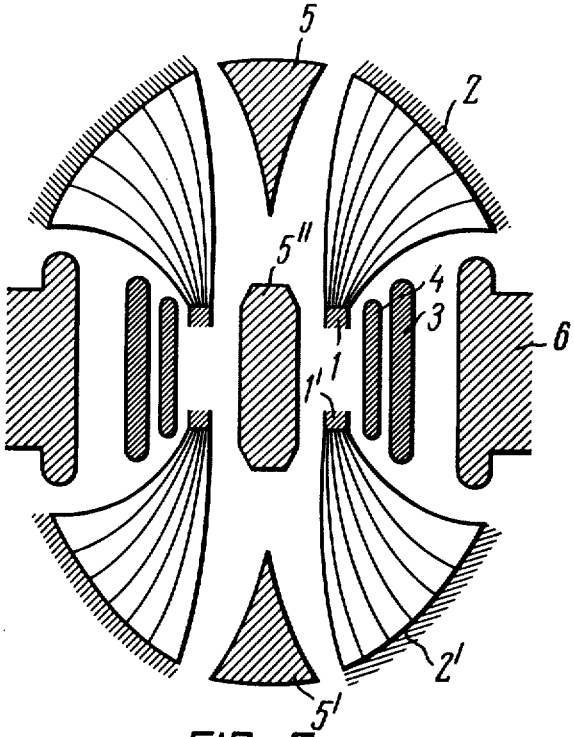
FIG. 5 shows an embodiment of the proposed converter, wherein use is made of two electron-optical systems, each having an annular cathode, with accelerating and control electrodes common for both systems.

The electron-beam converter of FIG. 5 has two cathodes 1 and 1', two anodes 2 and 2', an acceleratng electrode 3 and a control electrode 4. The cathodes 1 and 1' are annular and have flat emitting surfaces, the arrangement of these cathodes being such that electrons are emitted in opposite directions, and each cathode has a respective anode 2,2' with a surface orthogonal relative to the divergent electron flow and disposed with respect to its cathode 1 or 1' so that the angle between normals to these surfaces is greater than zero but less than 180°. Arranged in the openings of these angles is the accelerating electrode 3 which is common for both cathodes 1, 1', and the distances between the accelerating electrode 3 and anodes 2,2' are substantially greater than those between the cathodes 1, 1' and the accelerating electrode 3. The control electrode 4 is inserted between the outer edges of the cathodes 1, 1' and the accelerating electrode 3, the electrode 4 being common for both electron-optical systems, too. Such an arrangement enables heavier currents to be switched due to the expanded cathode surface and is structurally simpler.

Figure 6:
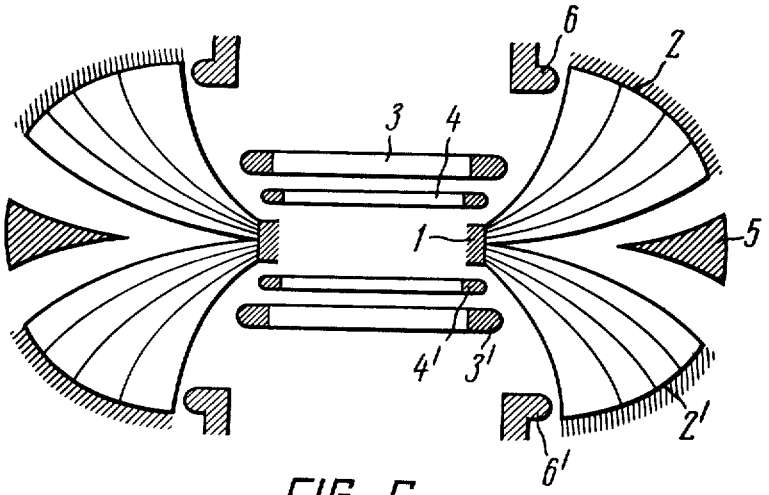
FIG. 6 shows an embodiment of the proposed converter with a cylindrical cathode.

The electron-beam converter shown in FIG. 6 comprises a cathode 1, two anodes 2 and 2', two accelerating electrodes and 3 3', and two control electrodes 4 and 4'. The cathode 1 is cylindrical in shape with the side surface of the cylinder serving as the emitting surface. The anodes 2, 2' are made annular and arranged on either side of the cathode 1, their axis of symmetry coinciding with that of the cathode 1. The surfaces of the anodes 2 and 2' are orthogonal relative to the divergent electron flow, and the angle between normals to the surfaces of the cathode 1 and each anode 2,2' is greater than zero but less than 180°. The annular accelerating electrodes 3, 3' are disposed in the openings of these angles, and the distances between the accelerating electrodes 3, 3' and the anodes 2, 2' are substantially greater than those between the cathode 1 and the accelerating electrodes 3, 3', just as in the embodiments described above. Both control electrodes 4 and 4' are arranged near the cathode 1, between the latter and each accelerating electrode 3, 3'. The control electrodes 4, 4' and accelerating electrodes 3, 3'are arranged symmetrically with the cathode 1 on either side thereof. Disposed opposite the cathode 1 is an annular cathode-adjacent focusing electrode 5 with a conical inner surface, while inserted between the accelerating electrodes 3, 3' and anodes 2, 2' are anode-adjacent focusing electrodes 6, 6'. Such an arrangement permits heavier currents to be switched due to the larger emitting surface of the cathode without any increase in the size of the converter, while expanding the anode surface minimizes thermal losses and, hence, enhances the efficiency of the converter.

Figure 7:
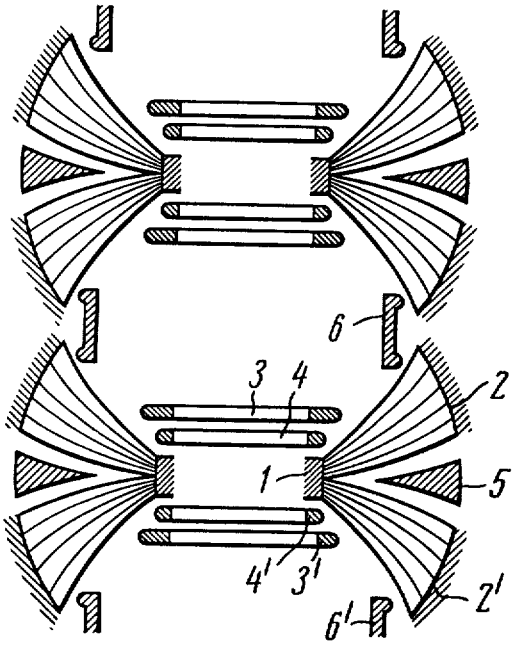
FIG. 7 shows an embodiment of the proposed converter, wherein a plurality of electron-optical systems are arranged on a common axis, and each having a cylindrical cathode.

The electron-beam converter of FIG. 7 comprises a plurality of electron-optical systems each being similar to that shown in FIG. 6 and comprising a cathode 1, two anodes 2 and 2', two accelerating electrodes 3 and 3' arranged on a common axis, and two control electrodes 4 and 4'.

The systems are arranged on a common axis which is the axis of symmetry for each system. In this embodiment, anode-adjacent focusing electrodes 6 and 6' may be common for two adjacent systems (e.g. electrode 6). The use of a plurality of similar electron-optical systems enables substantially heavier currents to be switched due to the expanded emitting surface of the cathode.

Figure 8:
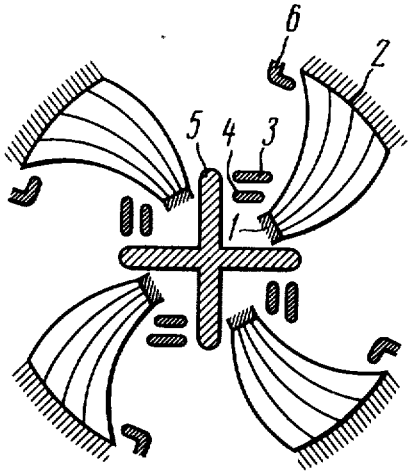
FIG. 8 shows an embodiment of the proposed converter, wherein use is made of a plurality of electronoptical systems each having an elongate ribbon-shaped cathode.

The electron-beam converter illustrated in FIG. 8 includes several electron-optical systems each having a cathode 1, an anode 2, an accelerating electrode 3, a control electrode 4, a cathode-adjacent focusing electrode 5, and an anode-adjacent focusing electrode 6. All of the systems are arranged relative the common axis of the converter so that anodes 2 are, in cross section, arcs of a common circumference. In each electron-optical system, the electrodes are made elongate, the anode 2 has a surface orthogonal with respect to the divergent electron flow, and the angle between normals to the cathode and anode surfaces is greater than zero but less than 180°, with the accelerating electrode 3 being disposed in the opening of this angle. The distance between the accelerating electrode 3 and the anode 2 is substantially greater than that between the cathode 1 and the accelerating electrode 3, the cathode-adjacent focusing electrode 5 being arranged on the side of the cathode 1 opposite to the accelerating electrode 3. To simplify the structure of the converter, the cathode-adjacent focusing electrode 5 is made in the form of an elongate cross and arranged along the axis around which individual electron-optical systems are grouped while the anode-adjacent focusing electrode 6 is inserted between the anode 2 and accelerating electrode 3. This particular embodiment of a simplified arrangement of individual electron-optical systems permits heavier currents to be switched owing to the expanded emitting surface of the cathode.

Figure 9:
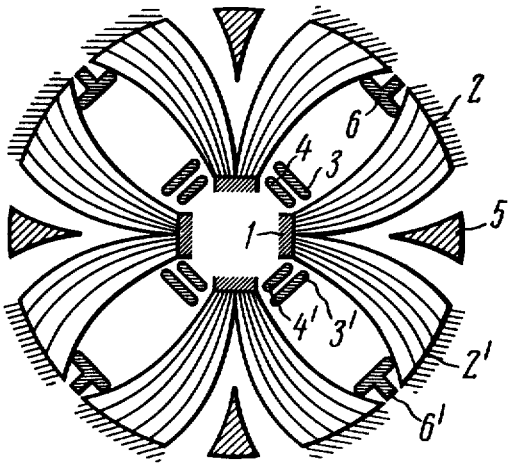
FIG. 9 shows an embodiment of the proposed converter, wherein a plurality of electron-optical systems are arranged on a common axis, each system having elongate electrodes and splitting the electron beam into two.

And finally turning to FIG. 9, the electron-beam converter therein comprises a plurality of electron-optical systems each being similar to that of FIG. 3, i.e. includes a cathode 1, two anodes 2 and 2', two accelerating electrodes 3 and 3' and two control electrodes 4 and 4'.

All the systems are so arranged with respect to the common axis of the converter, that the anodes 2, 2' are, in cross section, arcs of a common circumference, with all the electrodes in each electron-optical system being made elongate. The anodes 2, 2' are disposed on either side of the cathode 1, and their surfaces are orthogonal with respect to the divergent electron beam, while the angle between normals to the surfaces of the cathode 1 and each anode 2, 2' is greater than zero but less than 180°, the acclerating electrodes 3, 3' being disposed in the openings of these angles on either side of the cathode 1. The distances between the accelerating electrodes 3, 3' the anodes 2, 2' are substantially greater than those between the cathode 1 and the accelerating electrodes 3, 3'. The control electrodes 4 and 4' are located between the cathode 1 and each accelerating electrode 3, 3'. Arranged opposite the cathode 1 is a cathode-adjacent focusing electrode 5 having a conical inner surface, and disposed between the accelerating electrodes 3, 3' and anodes 2, 2' are anode-adjacent focusing electrodes 6 and 6'. The arrangement of individual electron-optical systems is such that the accelerating electrodes 3, 3', control electrodes 4, 4' and anode-adjacent focusing electrodes 6, 6' are common for two adjacent electron-optical systems. Such an arrangement permits switching heavier currents due to the larger emitting surface of the cathode with individual electron-optical systems being arranged in a convenient simple manner.

In the embodiments of the proposed electron-beam converter, described above and illustrated in FIGS. 2 to 9, the distribution of the electrode potentials is similar to that in the embodiment of FIG. 1.

What is claimed is:

1. An electron-beam converter comprising: a cathode; an anode; an accelerating electrode; control electrodes; all of said electrodes being made elongate; said control electrodes being arranged near said cathode on either side of an electron flow; a cathode-adjacent focusing electrode disposed on the cathode side opposite to said accelerating electrode, behind one of said control electrodes; an anode-adjacent focusing electrode inserted between said anode and said accelerating electrode; said anode having a surface orthogonal with respect to a divergent electron flow and being so arranged relative to said cathode that the angle between normals to the surfaces of said electrodes. is greater than zero but less than 180°; said accelerating electrode being disposed in the opening of said angle; the distance between said accelerating electrode and said anode being substantially greater than that between said cathode and said accelerating electrode; all of said electrodes making up an electron-optical system shaping said electron flow into a curvilinear beam broadening towards said anode so as to prevent electrons from impinging upon said accelerating electrode; the potentials across said electrodes being distributed so that applied to said accelerating electrode is a potential positive with respect to said cathode, the anode potential is also positive with respect to said cathode but is substantially lower than the accelerating electrode potential, said cathode-adjacent focusing electrode receives a potential close or equal to the cathode potential said anode-adjacent focusing electrode receives a potential close or equal to the anode potential, and said control electrodes have potentials equal to the cathode potential during the positive half-cycle, and negative with respect to said cathode during the negative half cycle.

2. An electron-beam converter as claimed in claim 1, wherein a grid is provided in proximity to said anode, whose potential being lower than the anode potential but higher than the cathode potential creates a minimum potential area near said anode, whereby the secondary electrons knocked out of said anode by the electron flow incident thereupon are suppressed.

3. An electron-beam converter comprising: a cathode; two anodes; two accelerating electrodes; two control electrodes; all of said electrodes being made elongate; said anodes having surfaces orthogonal with respect to an electron flow diverging in two opposite directions, relative to said cathode, and being so arranged that the angle between normals to the cathode surface and each anode surface is greater than zero but less than 180°; said two accelerating electrodes being disposed in the openings of these angles on either side of said cathode; the distances between said accelerating electrodes and said anodes being substantially greater than those between said cathode and each said accelerating electrodes; said control electrodes being arranged between said cathode and each said accelerating electrodes; anode-adjacent focusing electrodes arranged between each said anodes and a respective accelerating electrode; a cathode-adjacent focusing electrode disposed above said cathode between said anodes, symmetrically with the converter axis; all of said electrodes making up an electron-optical system shaping said electron flow into a curvilinear beam broadening towards said anodes so as to prevent electrons from impinging upon said accelerating electrodes; the potentials across said electrodes being distributed so that applied to said accelerating electrodes are potentials positive with respect to said cathode, the magnitude of said potentials being sufficient for taking off the required amount of current, the potentials across said anodes are also positive with respect to said cathode but are substantially lower than the potentials across said accelerating electrodes, said cathode-adjacent focusing electrode receives a potential close or equal to the cathode potential, said anode-adjacent focusing electrodes receive, a potential close or equal to the potential across a respective anode, and said control electrodes have potentials equal to the cathoe potential during the positive half-cycle, and negative with respect to said cathode during the negative half-cycle.

4. An electron-beam converter as claimed in claim 3, wherein a plurality of such electron-optical systems are arranged along a common axis so that their anodes are, in cross section, arcs of a common circumference, while said accelerating, said control and said anode-adjacent focusing electrodes are common for two adjacent electron-optical systems.

5. An electron-beam converter comprising: two cathodes; two anodes; an accelerating electrode; a control electrode; all of said electrodes being arranged concentrically relative to the axis of symmetry which coincides with the axis of said cathodes made in the form of rings with flat emitting surfaces; said cathodes being arranged so as to emit an electron flow in opposite directions; said anodes being made annular and having surfaces orthogonal with respect to a diverging electron flow, each of said anodes being so arranged relative to a respective cathode that the angle between normals to the cathode and said anode surfaces is greater than zero but less than 180°; said accelerating electrode, which is made cylindrical in shape, being common for both said cathodes; the distances between said accelerating electrode and said anodes being substantially greater than those between said cathodes and said accelerating electrode; said control electrode being made as a cylinder and inserted between said cathodes and accelerating electrode; an anode-adjacent focusing electrode located between said accelerating electrode and anodes; three cathode-adjacent focusing electrodes arranged along the axis of symmetry of said converter, two of said electrodes being disposed in the center of said anodes and made conical in shape, while the third electrode is disposed in the center of said cathodes and is made in the shape of a cylinder with a beveled edge; all said electrodes making up an electronoptical system shaping said electron flows into electron beams so as to prevent electrons from impinging upon said accelerating electrode; the potentials across said electrodes being distributed so that applied to said accelerating electrode is a potential positive with respect to said cathodes, the mangitude of said potential being sufficient for taking off the required amount of current, said anodes receive, a potential also positive relative to a respective cathode but substantially lower that the potential across said accelerating electrode, said cathode-adjacent focusing electrodes receive, a potential close or equal to a respective cathode potential, said anode adjacent focusing electrode receives a potential close or equal to the anode potential, and said control electrode has a potential equal to the cathode potential during the positive half-cycle, and negative with respect to said cathode during the negative half-cycle.

6. An electron-beam converter comprising: a cathode; two anodes; two accelerating electrodes; two control electrodes; said cathode being made in the form of a cylinder whose side surface serves as the emitting surface; said two anoes being made annular, having an axis of symmetry coinciding with that of said cathode and surfaces orthogonal with respect to a diverging electron flow, and being arranged on either sid of said cathode so that the angle between normals to the cathode and said anode surfaces is greater than zero but less than 180°; said accelerating electrodes, which are annular in shape, being disposed in the openings of said angles on either said of said cathode; the distances between said accelerating electrodes and said anodes being substantially greater than those between said cathode and said accelerating electrodes; said control electrodes, which are annular in shape, being inserted between said cathode and each of said accelerating electrodes symmetrically with the converter axis and said cathode; an annular cathode-adjacent focusing electrode with a conical inner surface, disposed opposite said cathode emitting surface; anode-adjacent focusing electrodes arranged between said accelerating electrodes and said anodes; all of said electrodes making up an electron-optical system shaping said electron flow into an electron beam so as to prevent electrons from impinging upon said accelerating electrodes; the potentials across said electrodes being distributed so that applied to each of said accelerating electrodes is a potential positive with respect to said cathode, the magnitude of said potential being sufficient for taking off the required amount of current, said anodes receive, a potential also positive with respect to said cathode but substantially lower than the potential across each said accelerating electrode, said cathode-adjacent focusing electrode receives a potential close or equal to the cathode potential, said anode-adjacent focusing electrodes receive, a potential close or equal to a respective anode potential, and said control electrodes have potentials equal to the cathode potential during the positive half-cycle, and negative with respect to said cathode during the negative half-cycle.

7. An electron-beam converter as claimed in claim 6, wherein a plurality of such electron-optical systems are arranged on a common axis.

8. An electron-beam converter comprising a plurality of electron-optical systems each including; a cathode; an anode; an accelerating electrode; a control electrode; a cathode-adjacent focusing electrode; an anode-adjacent focusing electrode; said electron-optical systems being arranged so that their anodes are, in cross section, arcs of a common circumference; all of said electrodes being made elongate; said anode having a surface orthogonal with respect to a diverging electron flow and so arranged with respect to said cathode that the angle between normals to the cathode and said anode surfaces is greater than zero but less than 180°; said accelerating electrode being disposed in the opening of said angle; the distance between said accelerating electrode and said anode being substantially greater than that between said cathode and said accelerating electrode; said control electrode being inserted between said cathode and said accelerating electrode; said cathode-adjacent focusing electrode being arranged on the cathode side opposite to said control electrode; said cathode-adjacent focusing electrode being shaped as an elongate cross, to facilitate integration of individual electron-optical systems into a single entity, and arranged along an axis relative to which individual electron-optical systems are grouped; said anode-adjacent focusing electrode being inserted between said anode and said accelerating electrode; all of said electrodes making up electron-optical systems shaping electron flows into electron beams so as to prevent electrons from impinging upon said accelerating electrodes; the potentials across said electrodes being distributed so that applied to said accelerating electrode is a potential positive with respect to said cathode, the magnitude of said potential being sufficient for taking off the required amount of current, the anode potential is also positive with respect to the cathode potential but substantially lower than the accelerating electrode potential, said cathode-adjacent focusing electrode receives a potential close or equal to the cathode potential, said anode-adjacent focusing potential receives a potential close or equal to the anode potential, and said control electrode has a potential equal to the cathode potential during the positive half-cycle, and negative with respect to said cathode during the negative half-cycle.

9. An electron-beam converter comprising: a cathode; an anode; an accelerating electrode; a control electrode; all of said electrodes being made annular and arranged concentrically relative to the axis of symmetry which coincides with the cathode axis, said cathode being made in the form of a ring with a flat emitting surface; said annular anode having a surface orthogonal with respect to a diverging electron flow and so arranged relative to said cathode that the angle between normals to the surfaces of these electrodes is greater than zero but less than 180°; said annular accelerating electrode being disposed in the opening of said angle; the distance between said accelerating electrode and said anode being substantially greater than that between said cathode and said accelerating electrode; said annular control electrode being arranged between said cathode and said accelerating electrode; an anode-adjacent focusing electrode inserted between said anode and said accelerating electrode; two cathode-adjacent focusing electrodes, one having a conical shape and being located in the center of said anode, while the other is cylindrical in shape and located in the center of said cathode; all said electrodes making up an electron-optical system shaping said electron flow into an electron beam so as to prevent electrons from impinging upon said accelerating electrode; the potentials across said electrodes being distributed so that applied to said accelerating electrode is a potential positive with respect to said cathode, the magnitude of said potential being sufficient for taking off the required amount of current, the anode potential is also positive with respect to said cathode but is substantially lower than the potential across said accelerating eelctrode, said cathode adjacent focusing electrode receives a potential close or equal to the cathode potential, said anode-adjacent focusing electrode receives a potential close or equal to the anode potential, and said control electrode has a potential equal to the cathode potential during the positive half-cycle, and negative with respect to said cathode during the negative half-cycle.

* * * * *